US007426899B1

(12) United States Patent
Heva

(10) Patent No.: US 7,426,899 B1
(45) Date of Patent: Sep. 23, 2008

(54) FLAG RAISING GUIDING DEVICE

(76) Inventor: Richard Heva, 6056 E. Butte Street, Mesa, AZ (US) 85205

( * ) Notice: Subject to any disclaimer, the term of this patent is extended or adjusted under 35 U.S.C. 154(b) by 0 days.

(21) Appl. No.: 11/385,856

(22) Filed: Mar. 21, 2006

(51) Int. Cl.
*G09F 17/00* (2006.01)

(52) U.S. Cl. ..... 116/173

(58) Field of Classification Search ..... 116/173, 116/174, 175
See application file for complete search history.

(56) References Cited

U.S. PATENT DOCUMENTS

| | | | | | |
|---|---|---|---|---|---|
| 1,645,645 | A | * | 10/1927 | Davis | 116/173 |
| 1,645,691 | A | * | 10/1927 | Davis | 116/173 |
| 1,646,015 | A | * | 10/1927 | Davis | 116/173 |
| 2,327,056 | A | * | 8/1943 | Nelson | 116/173 |
| 2,377,219 | A | * | 5/1945 | Ellis | 116/173 |
| 2,440,500 | A | * | 4/1948 | Ellis | 116/173 |
| 2,630,779 | A | * | 3/1953 | Mader | 116/173 |
| 3,300,185 | A | * | 1/1967 | Metzger et al. | 254/134.3 R |
| 3,417,732 | A | * | 12/1968 | Platt, Jr. | 116/173 |
| 3,418,967 | A | * | 12/1968 | Donkersloot | 116/173 |
| 3,675,615 | A | * | 7/1972 | Stangarone et al. | 116/173 |
| 3,923,001 | A | * | 12/1975 | Murdock | 116/173 |
| 3,952,695 | A | * | 4/1976 | Vollstedt | 116/173 |
| 3,976,283 | A | * | 8/1976 | Schmit | 254/387 |
| 4,103,642 | A | * | 8/1978 | Swenson | 116/174 |
| 4,141,169 | A | * | 2/1979 | Rieth | 242/394.1 |
| 4,949,525 | A | * | 8/1990 | Weaver | 52/736.1 |
| 6,668,750 | B1 | * | 12/2003 | Walz et al. | 116/173 |
| 7,134,556 | B1 | * | 11/2006 | McCauley | 209/507 |
| 2001/0010201 | A1 | * | 8/2001 | Otterness | 116/173 |
| 2005/0193940 | A1 | * | 9/2005 | Swenson | 116/174 |
| 2006/0021562 | A1 | * | 2/2006 | Laird et al. | 116/174 |

* cited by examiner

*Primary Examiner*—R. A. Smith
(74) *Attorney, Agent, or Firm*—Michael I. Kroll

(57) ABSTRACT

A device for the lowering and raising of a flag having a tubular hollow body used to house and protect the flag while lowered and having a crank assembly with a plurality of line leads for to make raising and lowering of a flag by its flag line an easier task. Additionally the present invention is composed of a plurality of sections that may be attached to any existing flagpole via clamps or other fastening means.

15 Claims, 10 Drawing Sheets

FLAG RAISING GUIDING DEVICE

BACKGROUND OF THE INVENTION

1. Field of the Invention

The present invention relates generally to flag poles and, more specifically, to a device for the improved lowering, raising and storage of a flag body comprising a housing formed of a plurality of tubular sections that connect to form an extending parallel hollow housing body with a crank and series of guides used to help the user raise or lower a flag more efficiently that extends local from the bottom portion of a flagpole to a higher location on a flagpole with the said section protecting and concealing the flag when not in use while being in the lowered position, also the present invention allows the user to have full view of the flag after the present invention has been used to raise the flag to the top end of a flagpole via its flag line and crank assembly. Additionally the present invention has a series of attachments and guides that work in cooperation with the crank to help direct the flag line into an organized arrangement that minimizes tangling and effort by the user during the raising or lowering of the flag.

2. Description of the Prior Art

There are other flag pole devices designed for raising or lowering a flag, but while these flag raising accessories may be suitable for the purposes for which they were designed, they would not be as suitable for the purposes of the present invention, as hereinafter described.

SUMMARY OF THE PRESENT INVENTION

A primary object of the present invention is to provide a device for the raising and lowering of a flag having a tubular hollow body used to house and protect the flag while lowered.

Another object of the present invention is to provide a device for the lowering and raising of a flag that allows the user to do so simply by turning a crank handle.

Yet another object of the present invention is to provide a device for the lowering and raising of a flag having a plurality of guides to ensure the smooth flow of flag line traveling up or down while the flag is in transition from being in the raised or lowered position.

Still yet another object of the present invention is to provide a device for the raising and lowering of a flag that can be installed on any existing flagpole.

Another object of the present invention is to provide a device for the lowering and raising of a flag having line leads to guide flag line into a free flowing direction and path.

Yet another object of the present invention is to provide a device for the lowering and raising of a flag that reduces the amount of work a user would typically expend maintaining or removing a flag in service.

Additional objects of the present invention will appear as the description proceeds.

The present invention overcomes the shortcomings of the prior art by providing a device for the lowering and raising of a flag having a tubular hollow body used to house and protect the flag while lowered and having a crank assembly with a plurality of line leads for to make raising and lowering of a flag by its flag line an easier task. Additionally the present invention is composed of a plurality of sections that may be attached to any existing flagpole via clamps or other fastening means.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
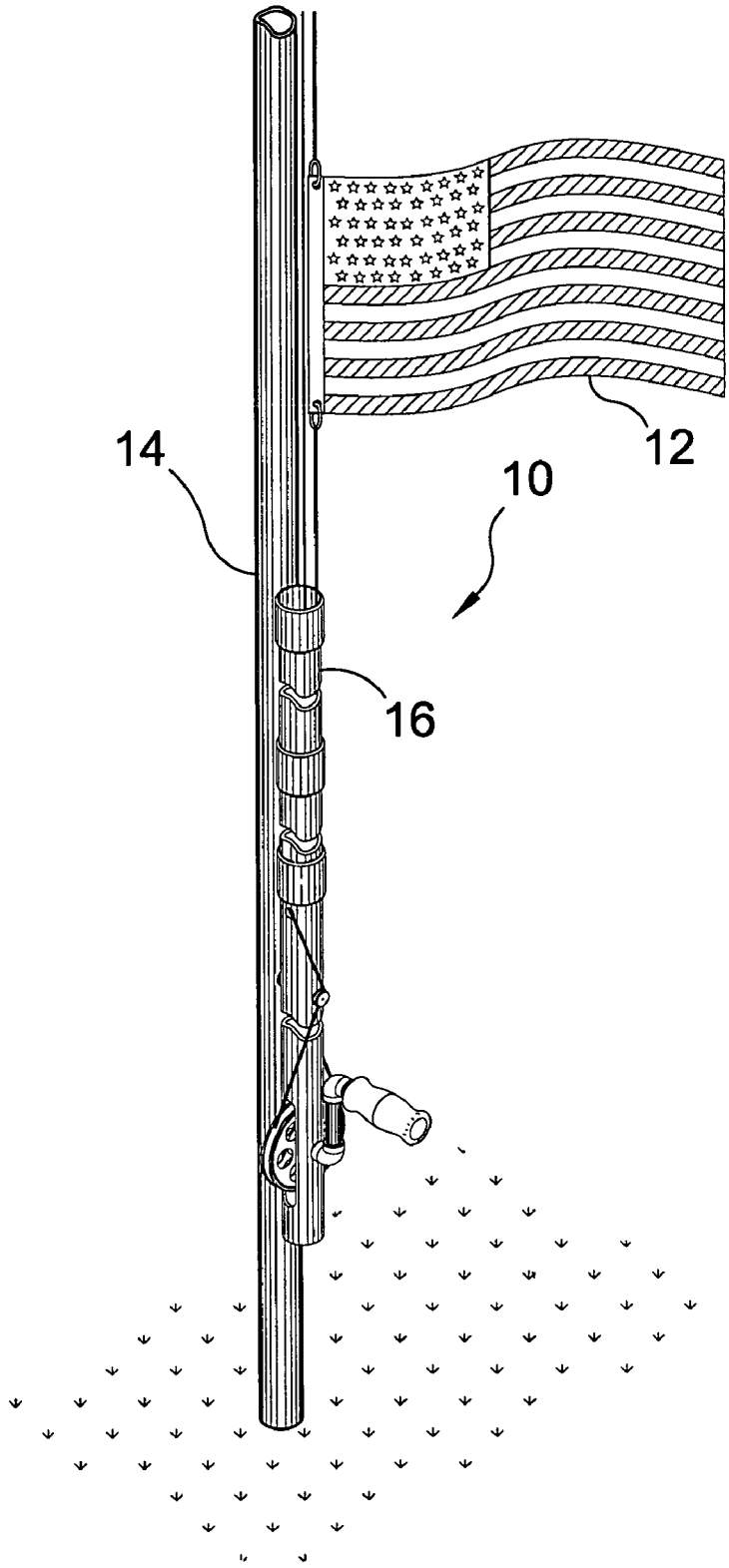
FIG. 1 is an illustrative view of the present invention's system for raising, lowering and housing a flag.

Turning now descriptively to the drawings, in which similar reference characters denote similar elements throughout the several views, the figures illustrate the Flag Pole Housing Apparatus of the present invention. With regard to the reference numerals used, the following numbering is used throughout the various drawing figures.

10 Flag Pole Housing Apparatus of the present invention
12 flag
14 flagpole
16 flag housing
18 lower tubular housing
20 middle tubular housing
22 upper tubular housing
24 crank assembly
26 line lead
28 crank pulley
30 pulley slots of 18
32 crank axle
34 crank handle
36 flag line
38 flag line aperture
40 90 degree elbow
42 extension
44 handle grip
46 axle cap

48 coupling
50 clamp members

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention 10 is a flag pole 14 housing apparatus 10 for raising, lowering and housing a flag 12. The flag 12 is lowered into the housing 16 during inclement weather. In turn, the housing apparatus 10 increases the longevity of the flag 12 by reducing wear and tear and also reduces the time and maintenance of flag 12 removal.

Figure 2:
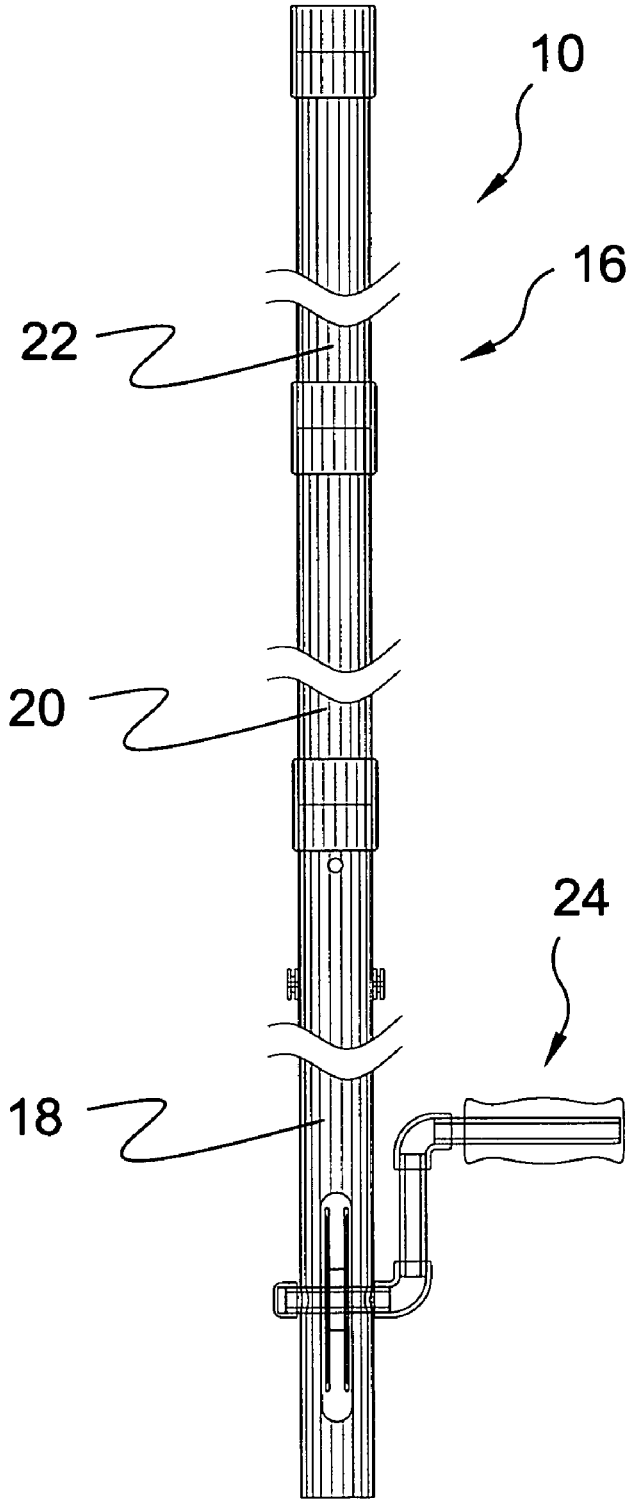
FIG. 2 is a front view of the present invention's system for raising, lowering and housing a flag.

FIG. 2 is a front view of the flagpole housing apparatus 10 for raising, lowering and housing a flag. The flag pole housing apparatus 10 comprises a crank assembly 24 and a lower tubular section 18, a middle tubular section 20 and an upper tubular housing 22 that are secured together to form the flag housing 16 and fastened to the lower end of a flag staff. The lower section 18 includes the crank assembly 24 that provides means to raise and lower the flag.

Figure 3:
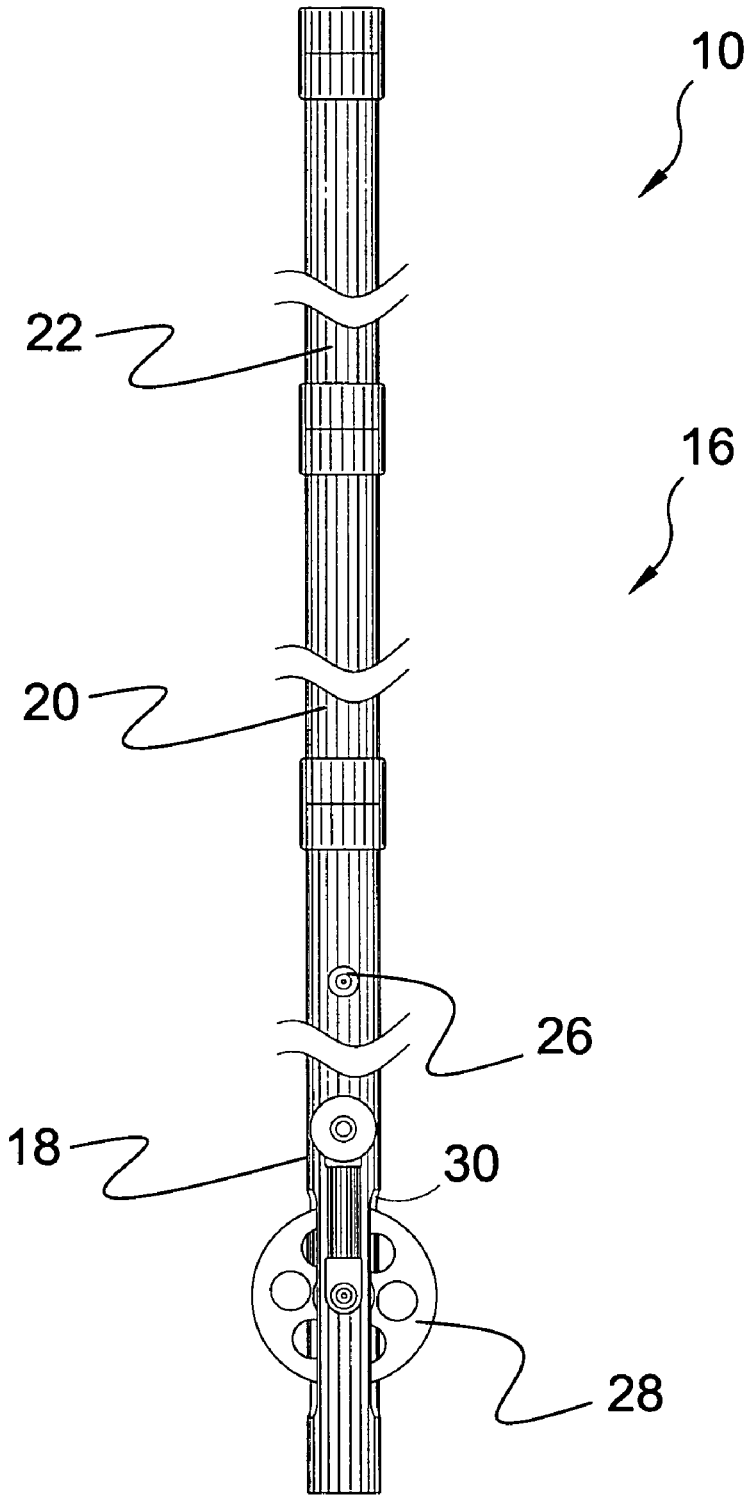
FIG. 3 is a side view of the present invention's system for raising, lowering and housing a flag.

FIG. 3 is a side view of the flagpole housing apparatus 10 for raising, lowering and housing a flag. The lower section 18 of the flag housing 16 retains the crank pulley 28, which extends therebeyond through a pair of opposing, elongate pulley slots 30 to centralize the pulley 28 within the tubular form. A pair of line leads 26 are also disposed on the lower section 18 to act as guides for the flag line that then extends through the middle section 20, the upper section 22 then up the flagpole to the flag.

Figure 4:
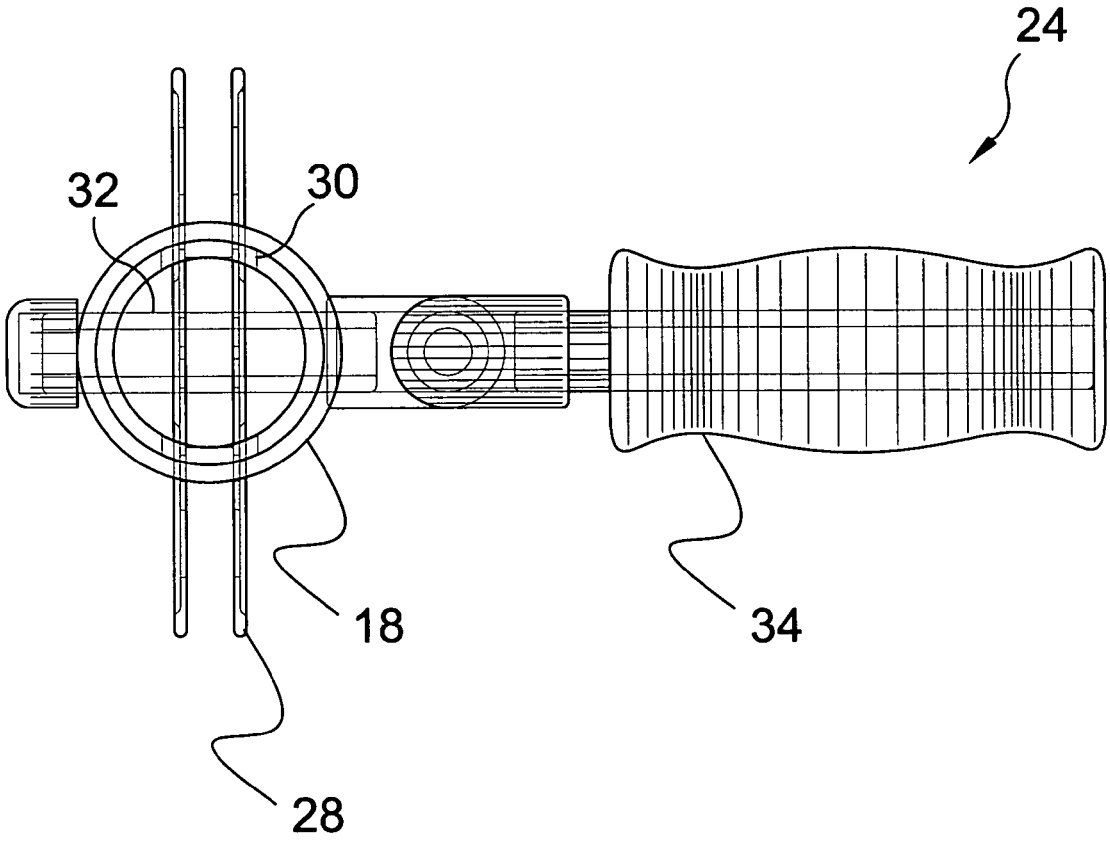
FIG. 4 is a top view of the present invention's system for raising, lowering and housing a flag.

FIG. 4 is a top view of the crank assembly 24 within the lower section 18 of the housing. The pulley 28 extends beyond the lower section 18 walls through opposing pulley slots 30 and is rotationally retained therein by the crank axle 32. A handle 34 with grip is further provided to manually rotate said pulley 28 during the operation thereof.

Figure 5:
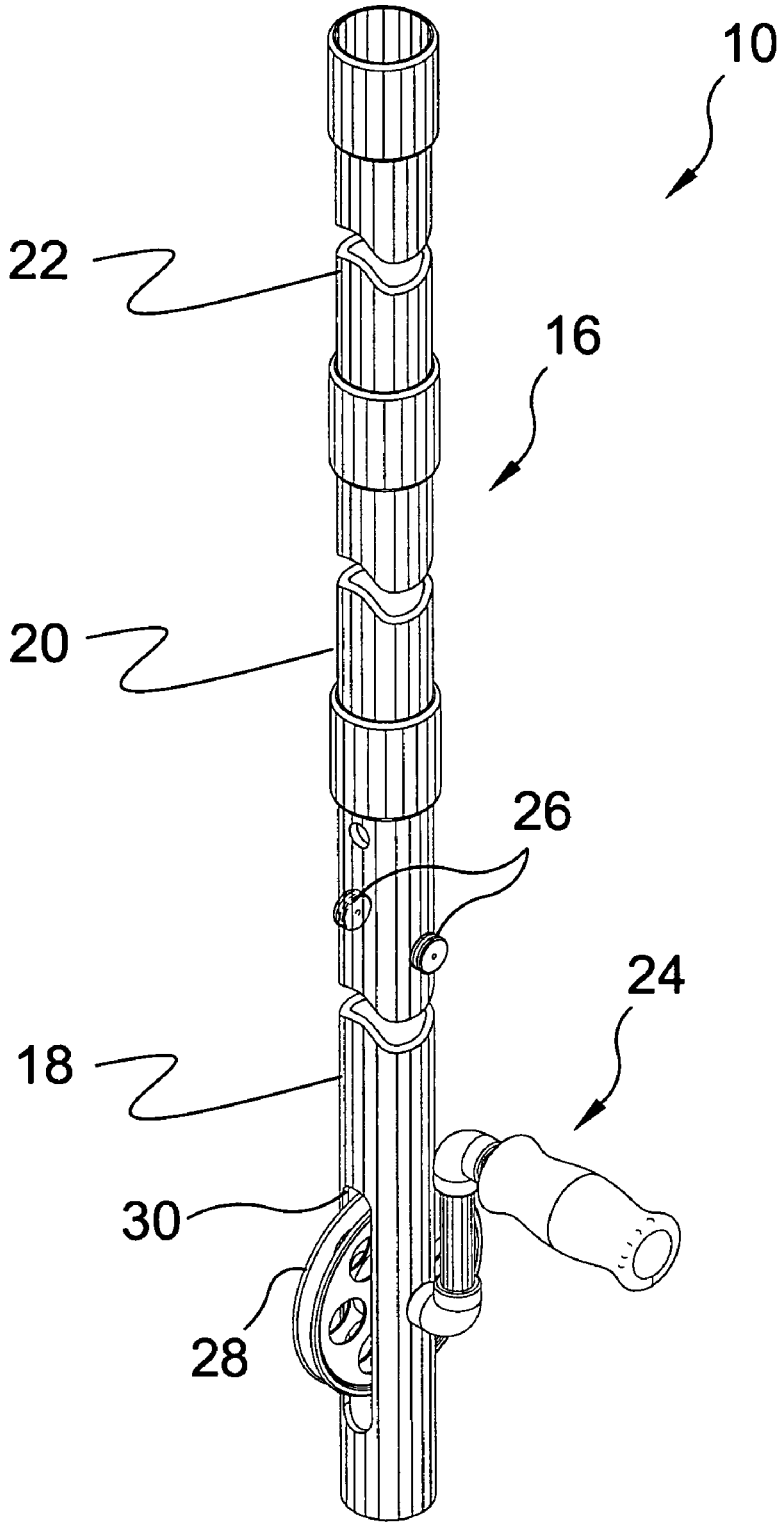
FIG. 5 is an isometric view of the present invention's system for raising, lowering and housing a flag.

FIG. 5 is an isometric view of the flagpole housing apparatus 10 for raising, lowering and housing a flag. The lower section 18 of the flag housing 16 retains the crank assembly 24 including the crank pulley 28, which extends therebeyond through a pair of opposing, elongate pulley slots 18 to centralize the pulley 28 within the tubular form. A pair of line leads 26 are also disposed on the lower section 18 to act as guides for the flag line that then extends through the middle section 20, the upper section 22 then up the flagpole to the flag. To withstand weather, the system is preferably made from non-corrosive materials such as PVC piping or the like.

Figure 6:
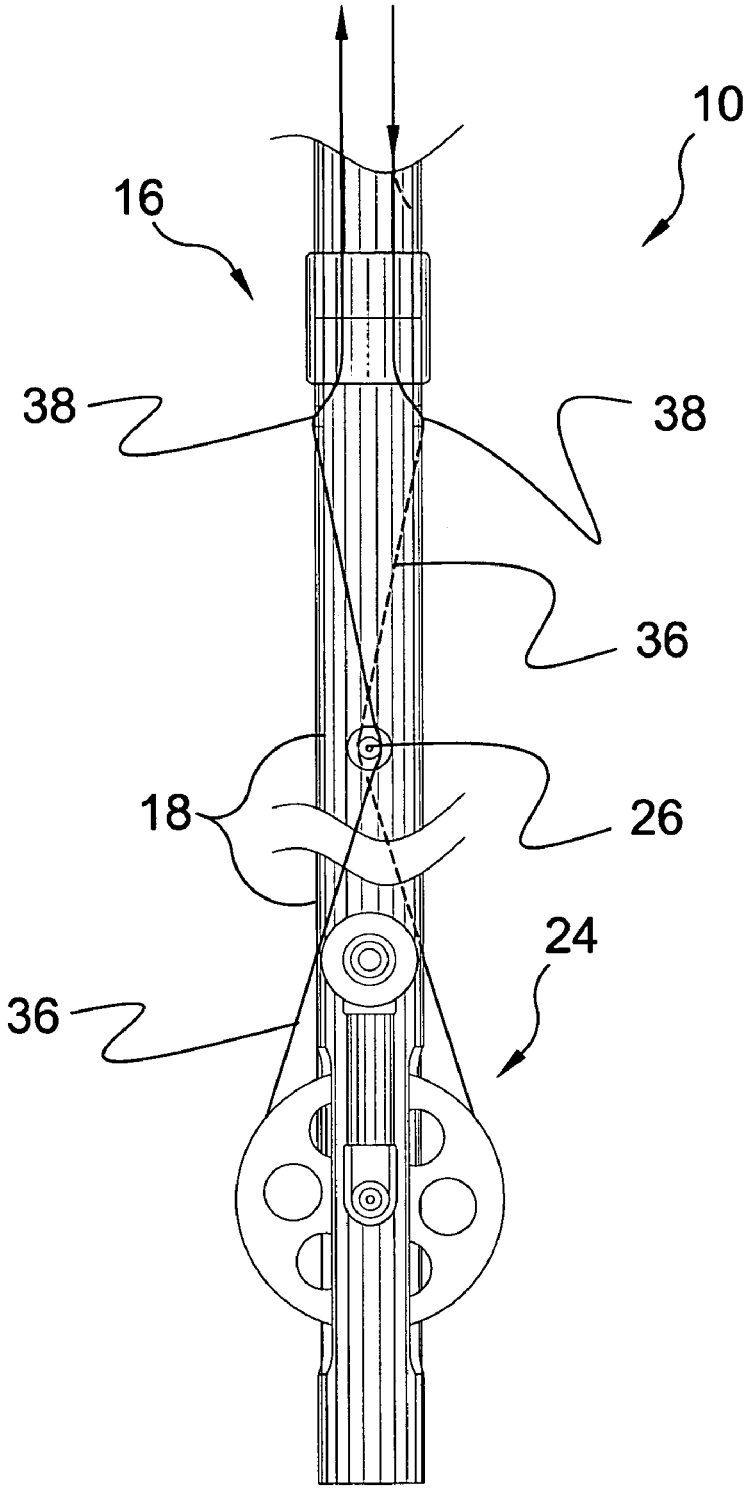
FIG. 6 is a side view of the present invention's system for raising, lowering and housing a flag.

FIG. 6 is a side view of the flagpole housing apparatus 10 for raising, lowering and housing a flag. A pair of line leads 26 are mounted slightly above the crank assembly 24 to ensure a taunt flag line 36 and prevent the entanglement thereof during raising and lowering of the flag. A pair of opposing apertures 38 in the lower section 18 allow the flag line 36 to be retained within the housing 16 and provides means for the flag to be lowered therein.

Figure 7:
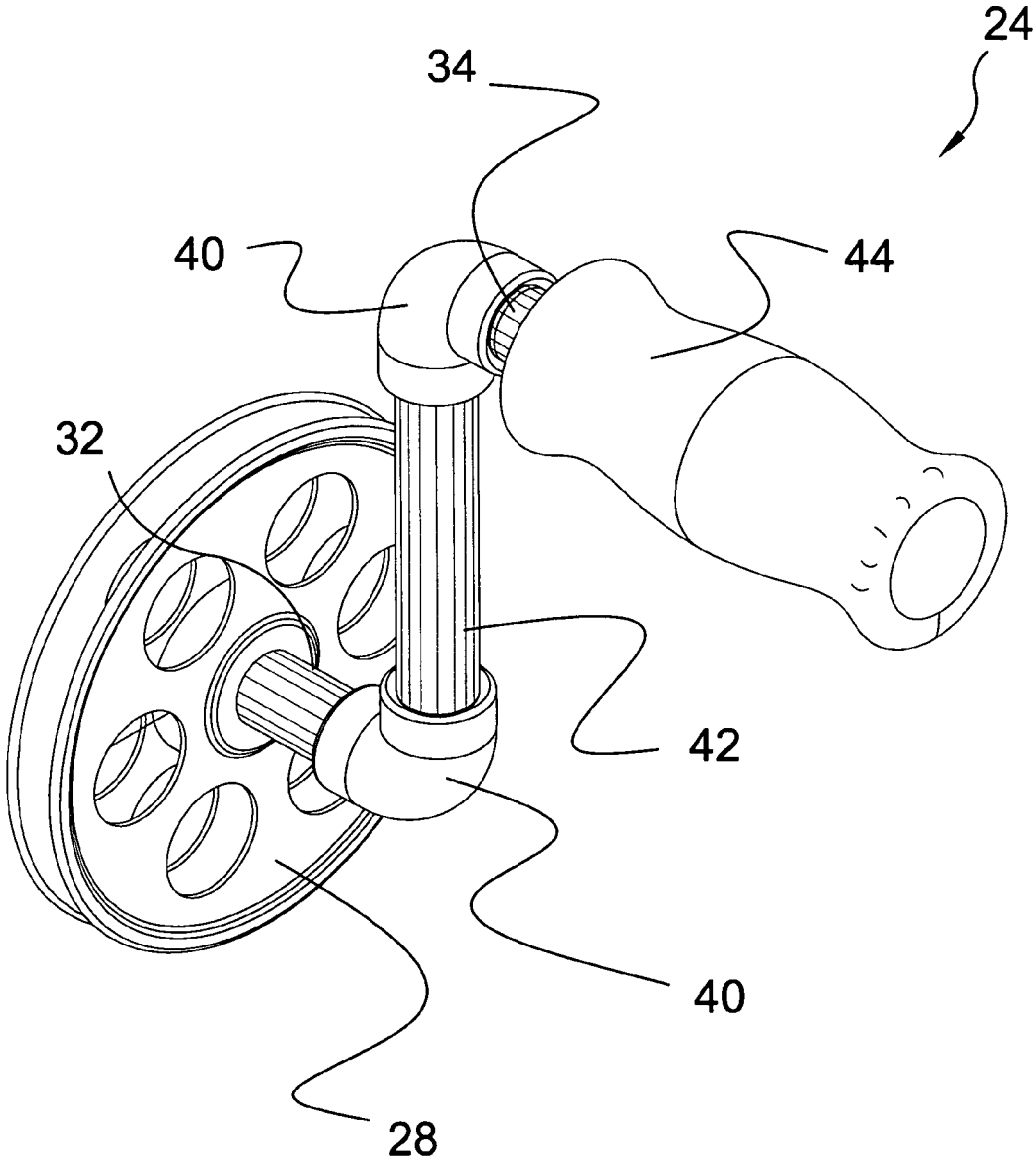
FIG. 7 is an isometric view of the present invention's system and crank assembly.

FIG. 7 is an isometric view of the crank assembly 24. The crank assembly 24 comprises a pulley 28, an axle 32, a 90 degree elbow 40 disposed on said axle 32, an extension 42 inserted into said elbow 40 and another 90 degree elbow 40 on the other end of the extension 42 oriented so that the handle 34 also inserted therein is oriented parallel to the axle 32. A grip 44 is secured over the tubular handle 34 to provide comfort for the user during raising and lowering of the flag.

Figure 8:
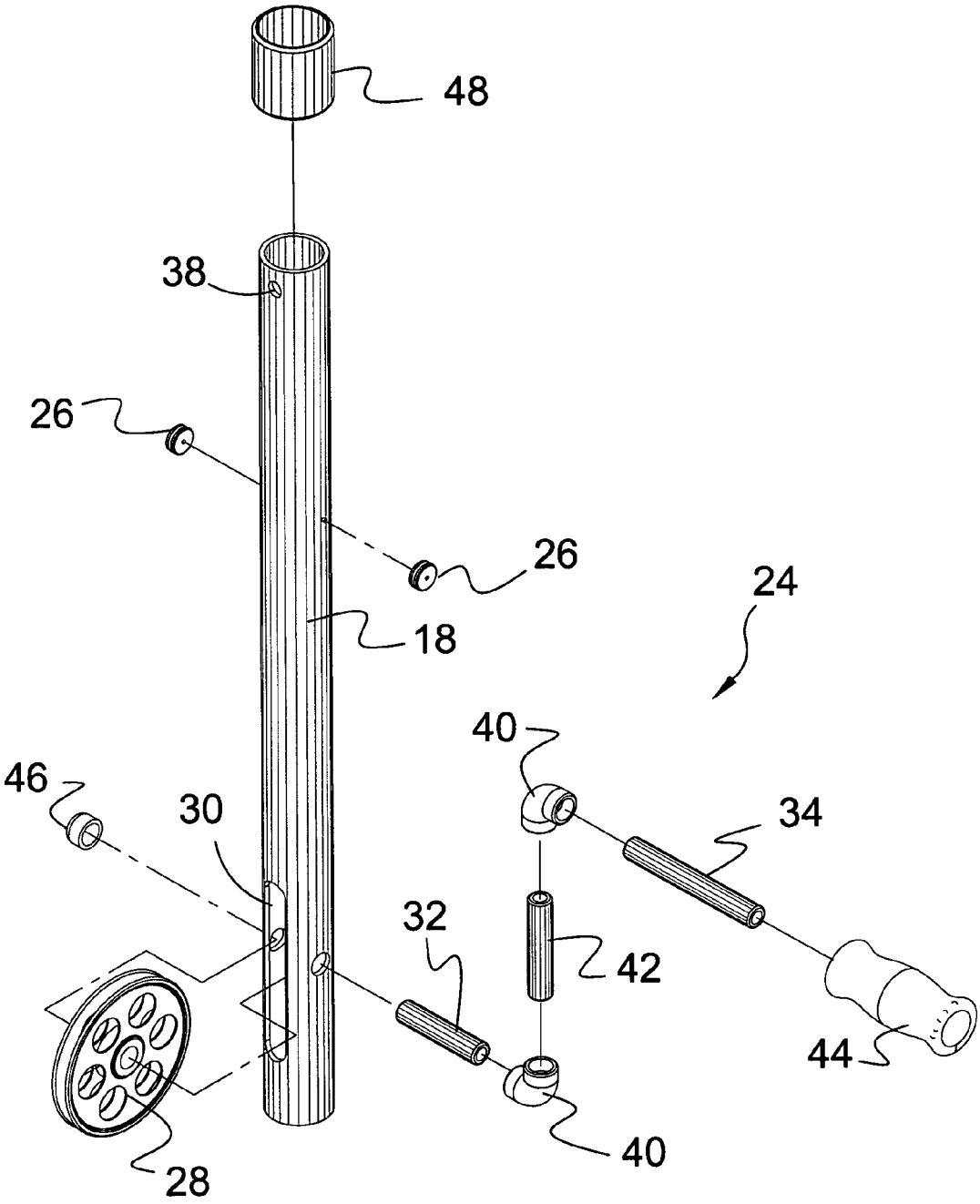
FIG. 8 is an isometric view of the present inventions system's lower section and crank assembly.

FIG. 8 is an exploded isometric view of the lower section 18 and crank assembly 24. The crank assembly 24 comprises a pulley 28, an axle 32, a cap 46 on one end of the axle 32, a 90 degree elbow 40 disposed on the other end of said axle 32, an extension 42 inserted into said elbow 40, another 90 degree elbow 40 on the other end of the extension 42 oriented so that the handle 34 also inserted therein is oriented parallel to the axle 32 and a grip 44 disposed on the handle 34. The lower tubular section 18 includes a pair of opposing pulley slots 30, a pair of opposing line leads 26 above the pulley slots 30 and a pair of opposing flag line apertures 38 disposed above and perpendicular to the line leads 26. Couplings 48 are used to connect the lower 18, middle and upper tubular housings.

Figure 9:
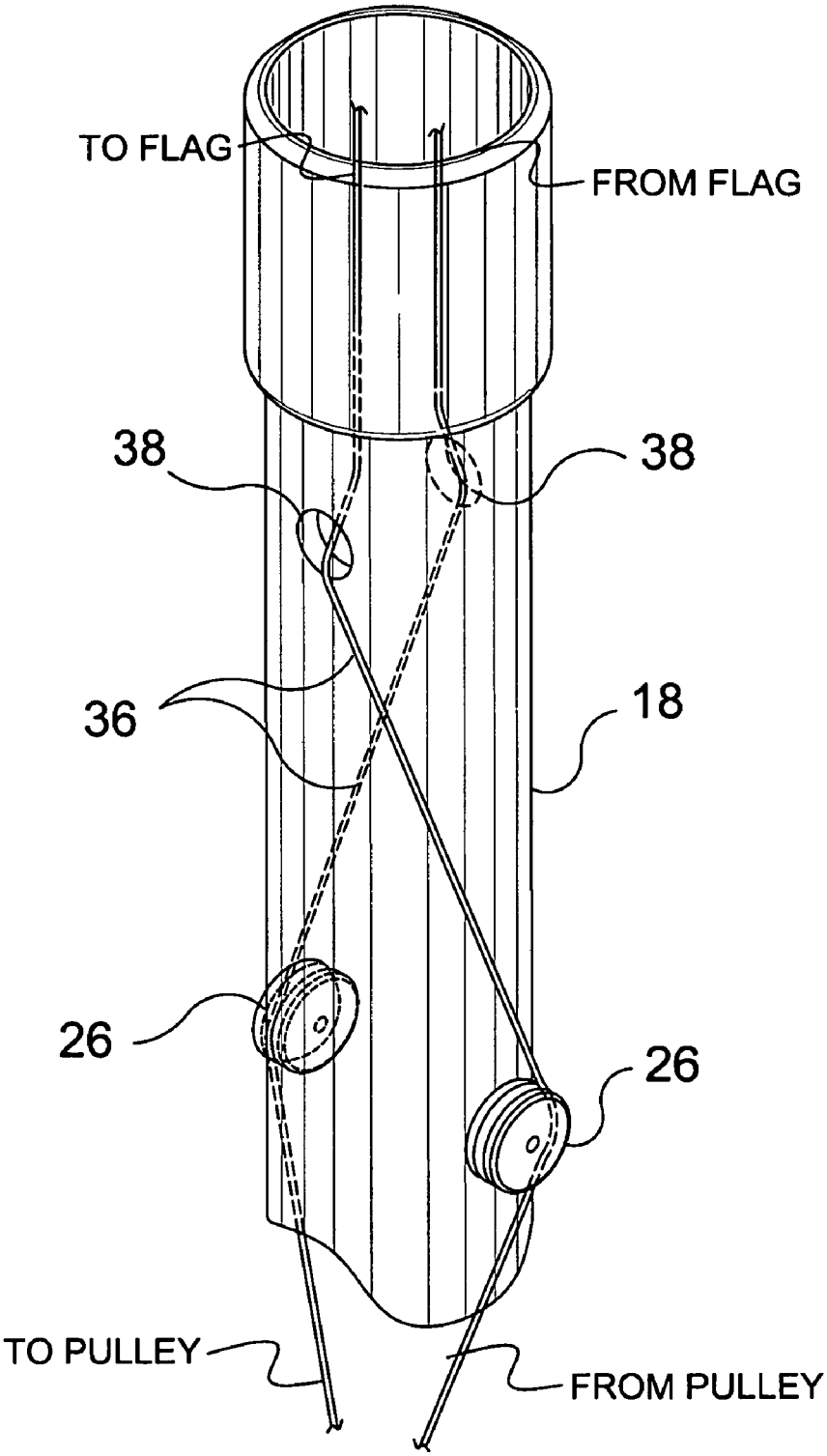
FIG. 9 is a detail view of the present invention system's line routing for raising and, lowering a flag.

FIG. 9 is a detail view of the flagpole housing apparatus method of routing the flag line 36. A pair of line leads 26 are mounted slightly above the crank assembly to ensure a taunt rope and prevent entanglement of the flag line 36 during raising and lowering of the flag. A pair of apertures 38 in the top portion of the lower section 18 allows the flag line 36 to be retained within the housing and provides means for the flag to be lowered therein.

Figure 10:
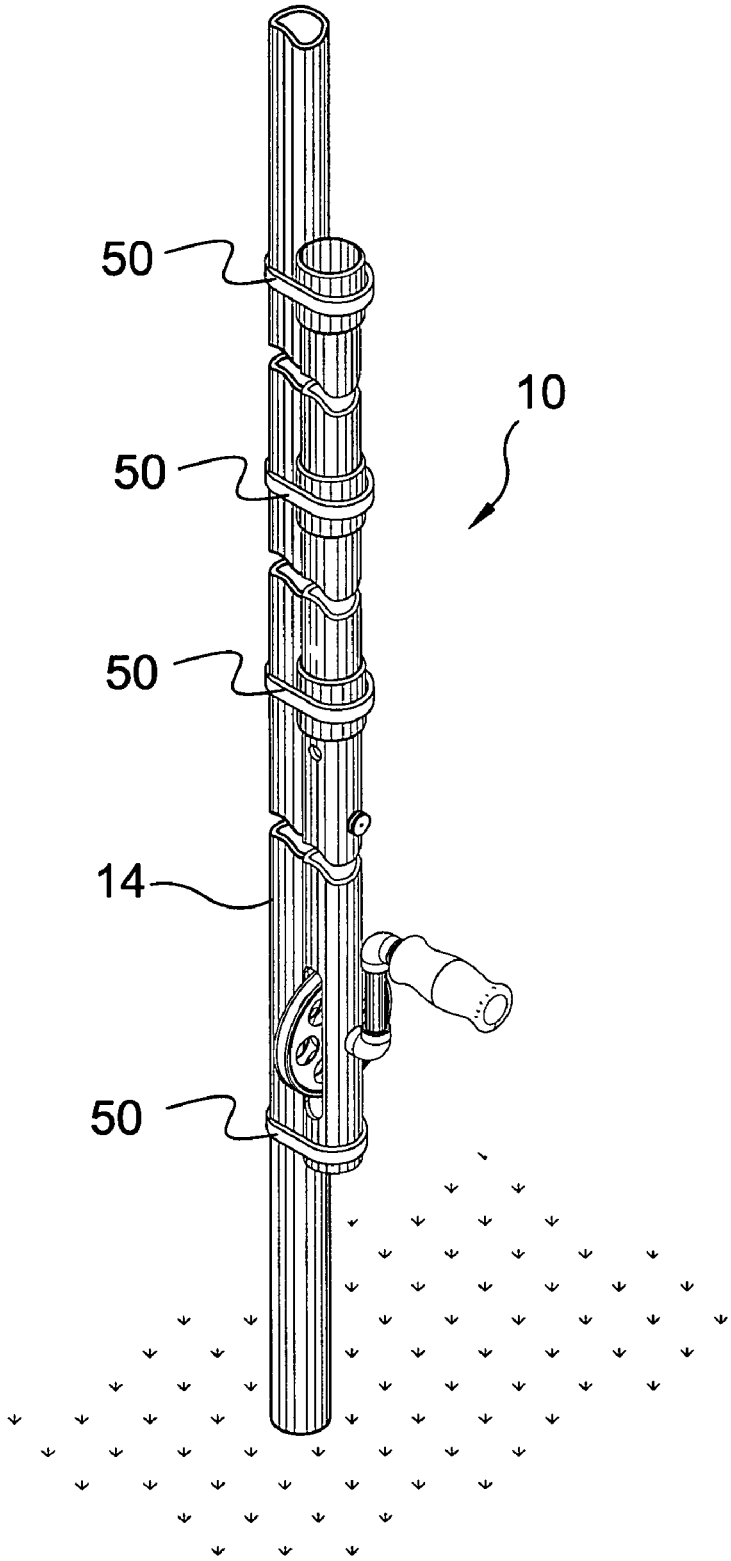
FIG. 10 is an isometric view of the present invention's system for raising, lowering and housing a flag.

FIG. 10 is an isometric view of the flagpole housing apparatus 10 in use. Shown is the flagpole housing apparatus 10 secured to a flagpole 14 by a plurality of clamp members 50. Any suitable clamp member 50 may be employed such as hose clamps, tie-wraps and the like that are suitable to accomplish the objective at hand.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention

What is claimed is new and desired to be protected by Letters Patent is set forth in the appended claims:

1. A flag pole housing apparatus for raising, lowering and storing a flag in a housing adjacent to a flagpole comprising:

a manual crank assembly having a pulley to pull one end of a flag line while feeding the other end in order to raise and lower a flag accordingly as needed;

a substantially tubular housing assembly for axially retaining said crank pulley therein and for storing said flag when in the lowered, stored position;

means for securing said housing assembly to said flagpole;

wherein said housing assembly comprises a first lower section, a second middle section, a third upper section and connection means for lineally connecting all three sections;

wherein said lower section of said housing assembly serves primarily to house said crank assembly and the related flag line routing components;

wherein said crank assembly comprises:

the pulley in communication with the flag line;

an axle for manually driving said pulley;

a cap disposed on one first end of said axle; and a handle for manually rotating said axle, said handle comprising:

a first 90-degree elbow disposed on the other end of said axle;

a tubular extension inserted into the other end of said elbow;

a second 90-degree elbow disposed on the end of said extension and oriented in a manner that is substantially parallel to said first elbow;

a handle inserted into said second elbow; and a hand grip substantially covering said handle;

wherein said lower housing section includes a pair of opposing, elongate slots to enable said crank pulley to reside within while a substantial portion thereof extends beyond said housing;

wherein said lower housing section further includes means for rotatively accepting said axle; and wherein said lower housing section further includes a pair of free-wheeling line leads exteriorly disposed superior to said pulley with each said line lead in a vertical plane with said axle.

2. The flagpole housing apparatus as recited in claim 1, wherein said lower housing section further includes a pair of flag line apertures disposed superior and perpendicular to said line leads.

3. The flagpole housing apparatus as recited in claim 2, wherein said flag line is routed from the flag down said flagpole, into said the housing assembly, out of the first flag line aperture, against the first line lead, around said pulley, around the second line lead, into the second flag line aperture into said housing and out of the top thereof to said flag.

4. The flagpole housing apparatus as recited in claim 3, wherein the rotation of the handle when the flag is in the raised position, turns the pulley and said flag line pulls said flag into said housing where it is stored and protected when not in use.

5. The flagpole housing apparatus as recited in claim 4, wherein the rotation of the handle when the flag is in the stored position, turns the pulley and said flag line pulls said flag out of said housing and up said flagpole.

6. The flagpole housing apparatus as recited in claim 1, wherein said connection means are couplings.

7. The flagpole housing apparatus as recited in claim 1, wherein said means of securing said housing to said flagpole is a plurality of clamps.

8. The flagpole housing apparatus as recited in claim 1, wherein said means of securing said housing to said flagpole is a plurality of tie-wraps.

9. The flagpole housing apparatus as recited in claim 1, wherein said components of the present invention are fabricated of a non-corrosive material.

10. The flagpole housing apparatus as recited in claim 9, wherein said components of the present invention are fabricated of PVC.

11. A flag pole housing apparatus for raising, lowering and storing a flag in a housing adjacent to a flagpole comprising:

a manual crank assembly having a pulley and an axle for manually driving said pulley, said pulley configured to pull one end of a flag line while feeding the other end in order to raise and lower a flag accordingly as needed;

a substantially tubular housing for axially retaining said crank pulley therein and for storing said flag when in the lowered, stored position;

means for securing said housing to said flagpole;

said housing including a pair of opposing, elongate slots to enable said crank pulley to reside within while a substantial portion thereof extends beyond said housing, and including flag line routing components;

wherein the flag line routing components comprises a pair of free-wheeling line leads exteriorly disposed superior to said pulley with each said line lead in a vertical plane with said axle, and a pair of flag line apertures disposed superior and perpendicular to said line leads.

12. The flag pole housing apparatus as recited in claim 11, wherein said housing includes a housing assembly which comprises a first lower section, a second middle section, a third upper section and connection means for lineally connecting all three sections.

13. The flag pole housing apparatus as recited in claim 12, wherein said lower section of said housing assembly serves primarily to house said crank assembly and the flag line routing components.

14. The flagpole housing apparatus as recited in claim 13, wherein said crank assembly comprises:

a) said pulley in communication with said flag line;

b) said axle for manually driving said pulley;

c) a cap disposed on a first end of said axle; and d) a handle for manually rotating said axle, said handle comprising: i) a first 90-degree elbow disposed on one end of said axle; ii) a tubular extension inserted into the other end of said elbow; iii) a second 90-degree elbow disposed on the end of said extension and oriented in a manner that is substantially parallel to said first elbow; iv) a handle inserted into said second elbow; and v) a hand grip substantially covering said handle.

15. The flagpole housing apparatus as recited in claim 13, wherein said lower housing section further includes means for rotatively accepting said axle.

* * * * *